United States Patent [19]

Wedel

[11] Patent Number: 5,037,509

[45] Date of Patent: Aug. 6, 1991

[54] APPARATUS FOR TRANSFERRING A THREADING TAIL OF A WEB

[75] Inventor: Gregory L. Wedel, Beloit, Wis.

[73] Assignee: Beloit Corporation, Beloit, Wis.

[21] Appl. No.: 605,639

[22] Filed: Oct. 29, 1990

[51] Int. Cl.[5] ..... D21F 7/00; D21F 7/04

[52] U.S. Cl. ..... 162/286; 162/193; 162/194; 162/255; 162/359

[58] Field of Search ..... 162/193, 194, 255, 286, 162/358, 359, 360.1; 34/117, 120

[56] References Cited

U.S. PATENT DOCUMENTS

| | | | |
|---|---|---|---|
| 4,014,740 | 3/1977 | Koponen et al. | 162/193 |
| 4,543,160 | 9/1985 | Kerttula et al. | 162/286 |
| 4,684,443 | 8/1987 | Kerttula et al. | 162/193 |
| 4,923,567 | 5/1990 | Liedes et al. | 162/194 |

FOREIGN PATENT DOCUMENTS

| | | | |
|---|---|---|---|
| 873690 | 6/1989 | Finland | 162/193 |

*Primary Examiner*—Karen M. Hastings

*Attorney, Agent, or Firm*—Dirk J. Veneman; Raymond W. Campbell; David J. Archer

[57] ABSTRACT

An apparatus is disclosed for transferring a threading tail of a web from a press section to a dryer section of a papermaking machine. The apparatus includes a press roll for releasably supporting the web and a doctor blade which cooperates with the press roll. A tail cutting device is disposed upstream relative to the blade for cutting the tail from the web. A lead-in roll is disposed adjacent to the press roll. The lead-in roll includes a suction tail box which cooperates with the tail. A device moves the lead-in roll from a first to a second location with the first location being in close proximity to the press roll such that when the tail box is connected to a source of vacuum, the tail is drawn away from the press roll onto a dryer felt extending around the lead-in roll. The second location is spaced from the press roll such that an open draw is established between the press roll and the lead-in roll. A tail guide is movable from a first to a second disposition with the first disposition being such that the guide is retracted from contact with the tail. The second disposition is such that the tail guide physically contacts the tail for urging the tail laterally relative to the lead-in roll into engagement with a threading rope system which extends around the lead-in roll.

5 Claims, 10 Drawing Sheets

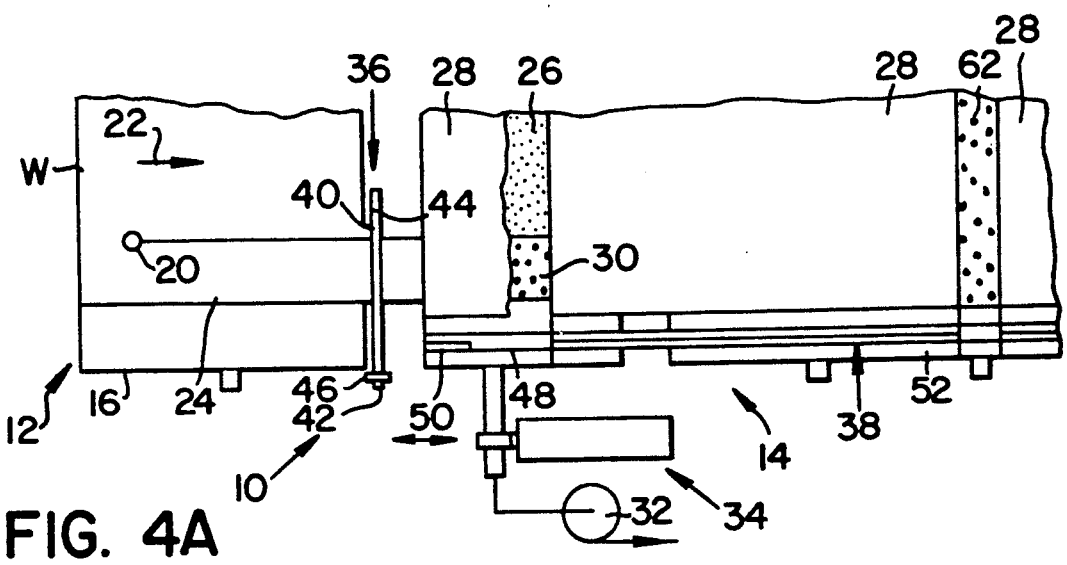
FIG. 4A
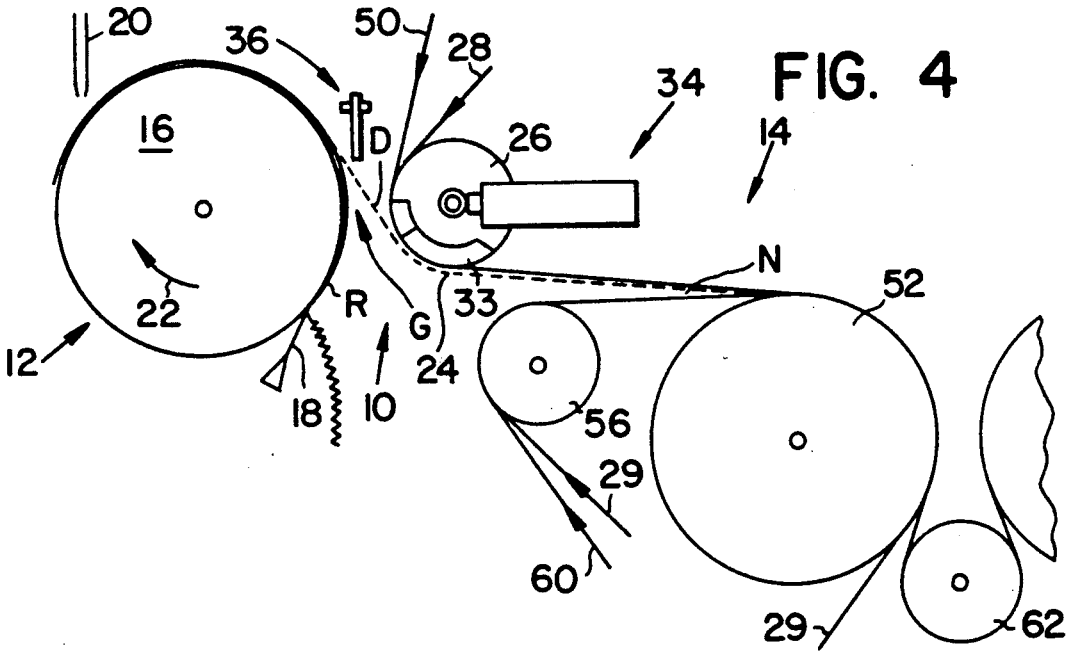
FIG. 4
FIG. 4B
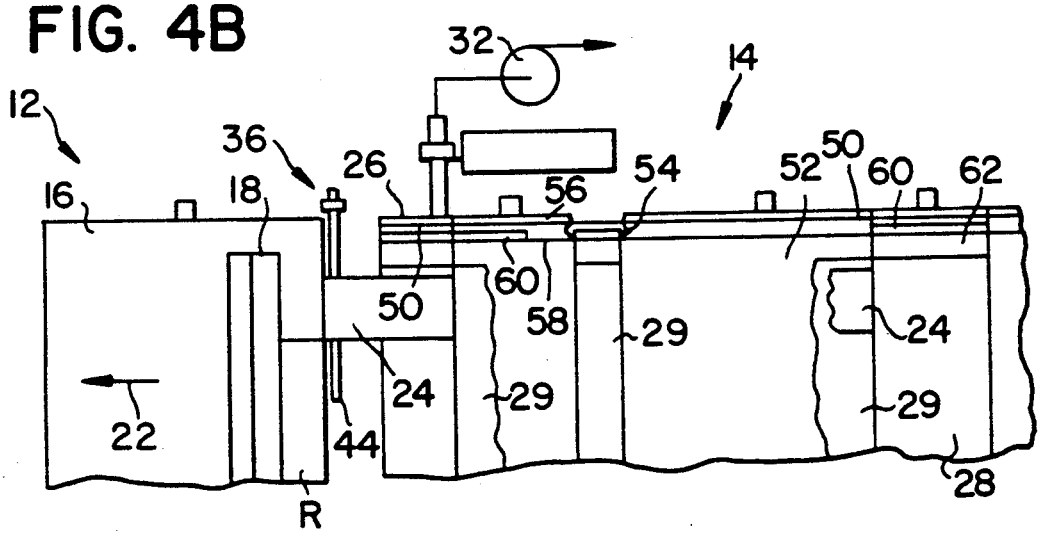

FIG. 6A
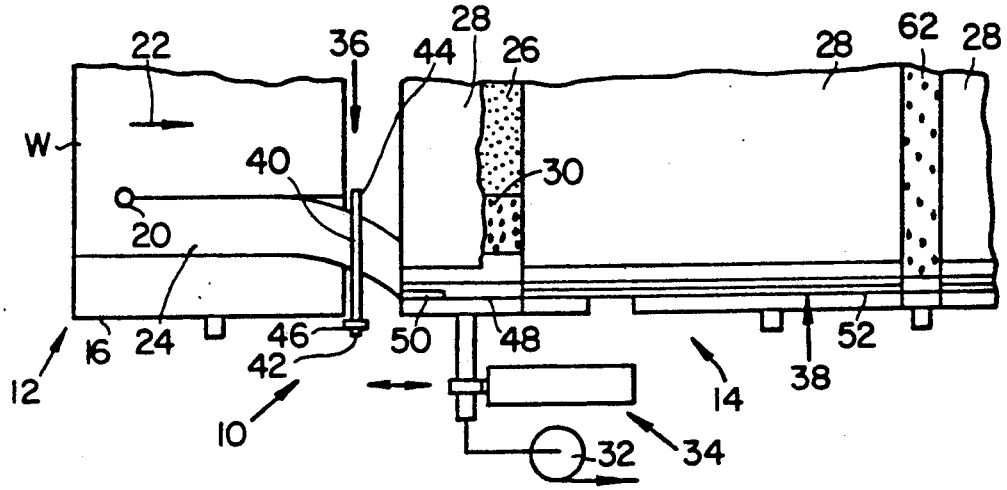
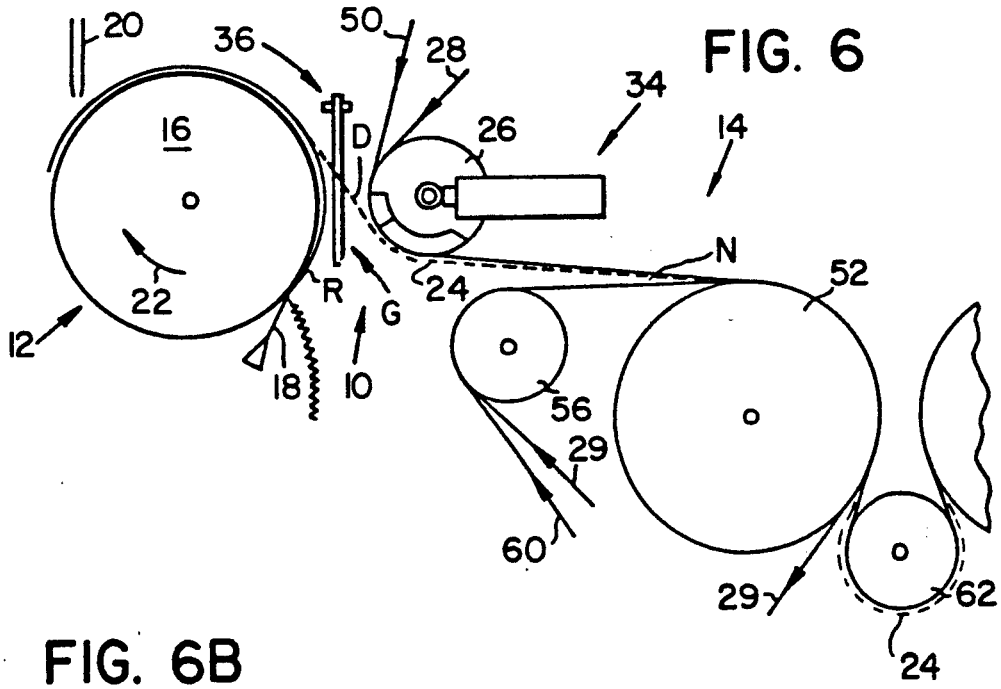
FIG. 6
FIG. 6B
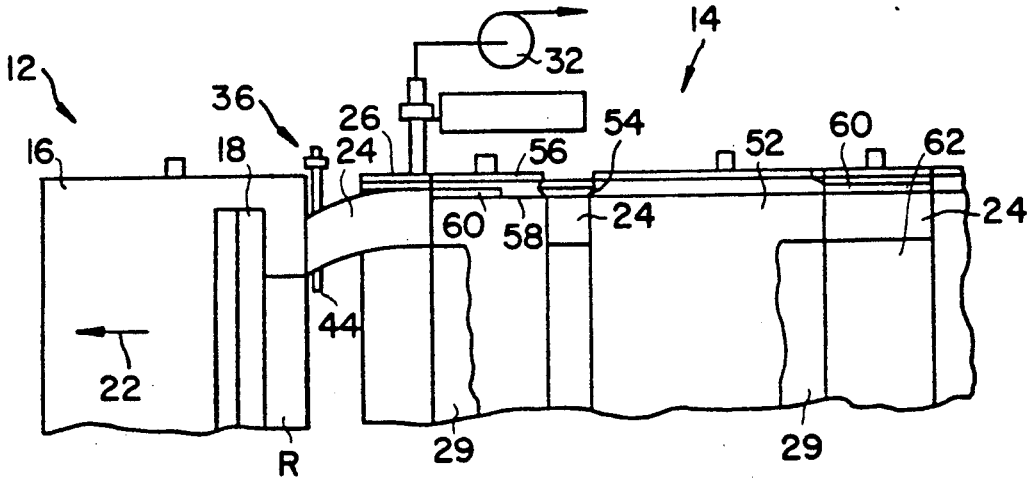

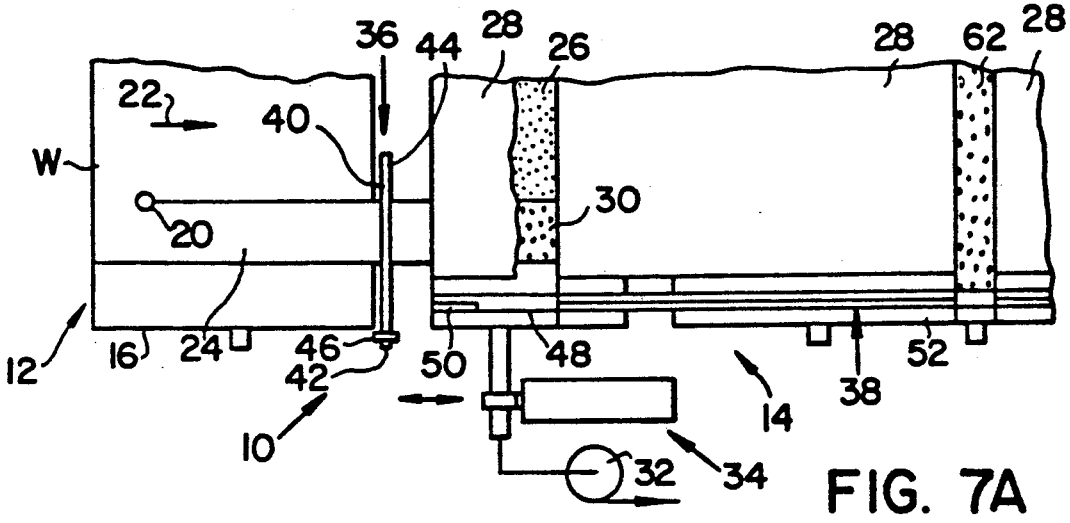
FIG. 7A
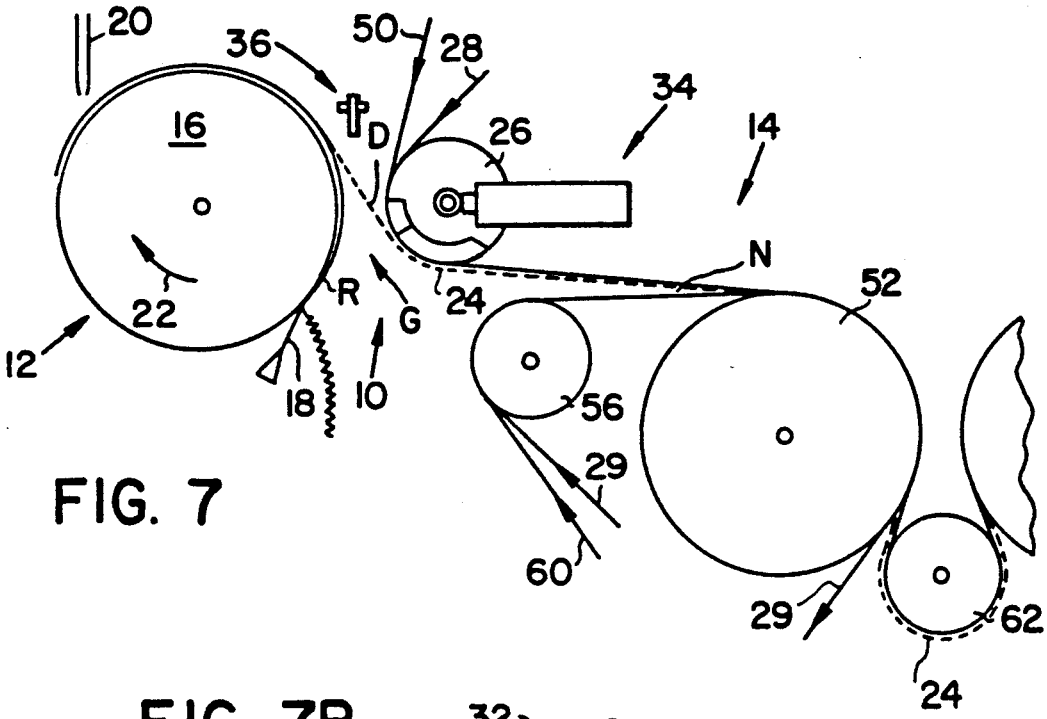
FIG. 7
FIG. 7B
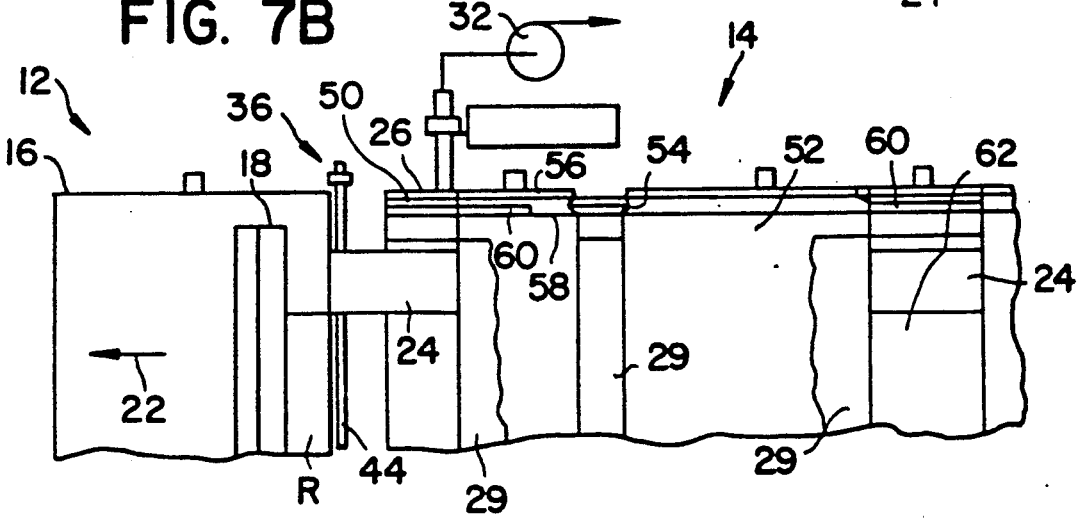

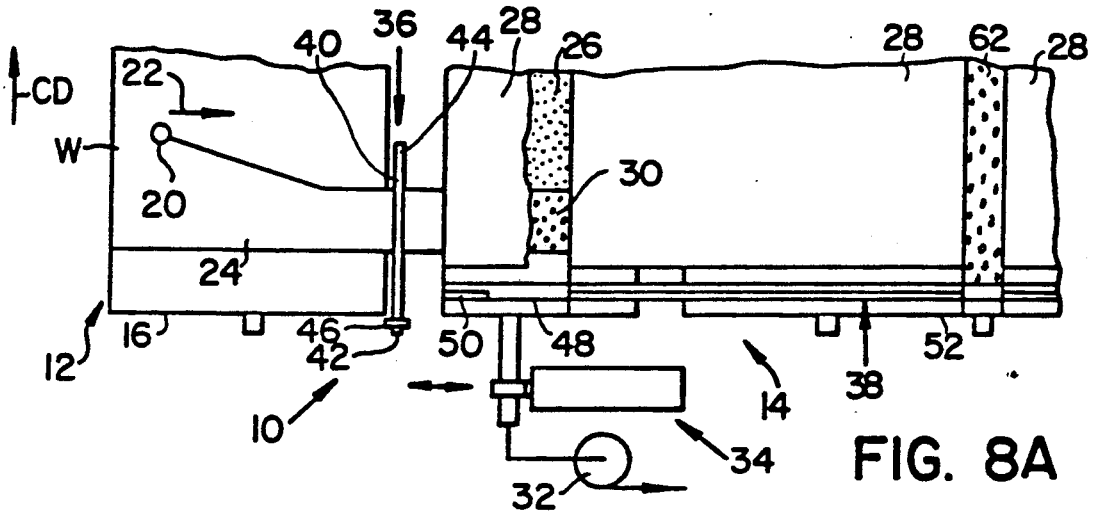
FIG. 8A
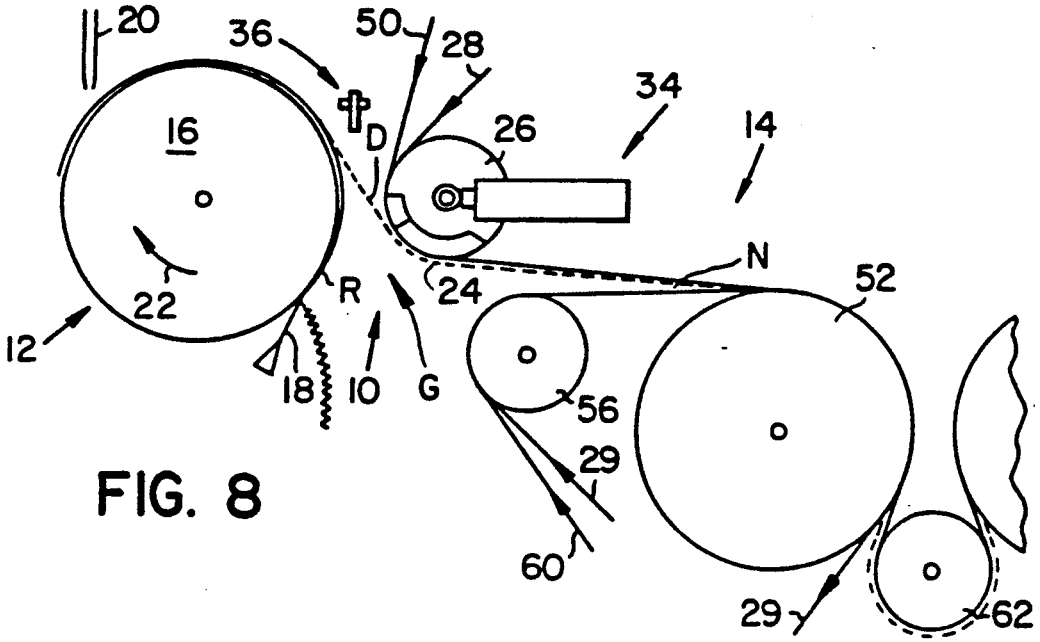
FIG. 8
FIG. 8B
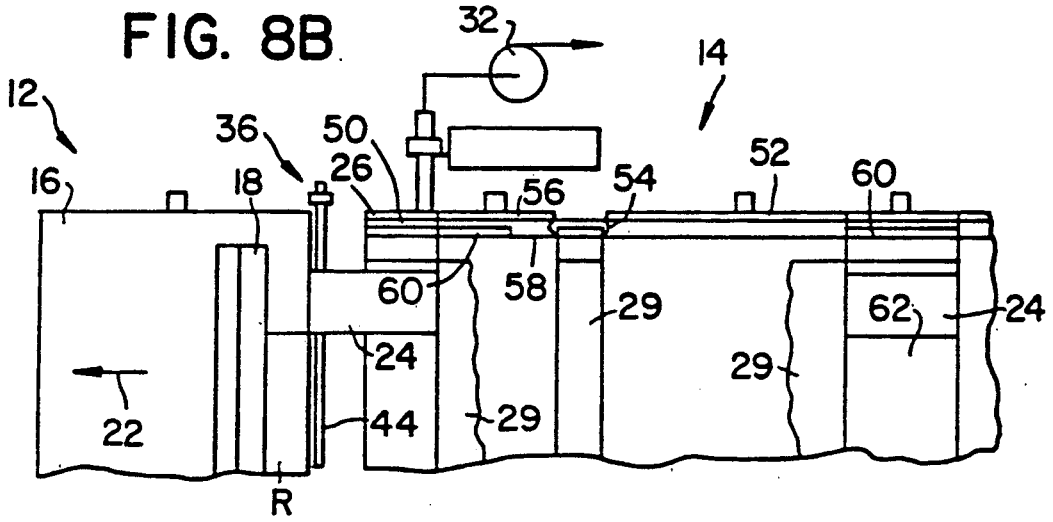

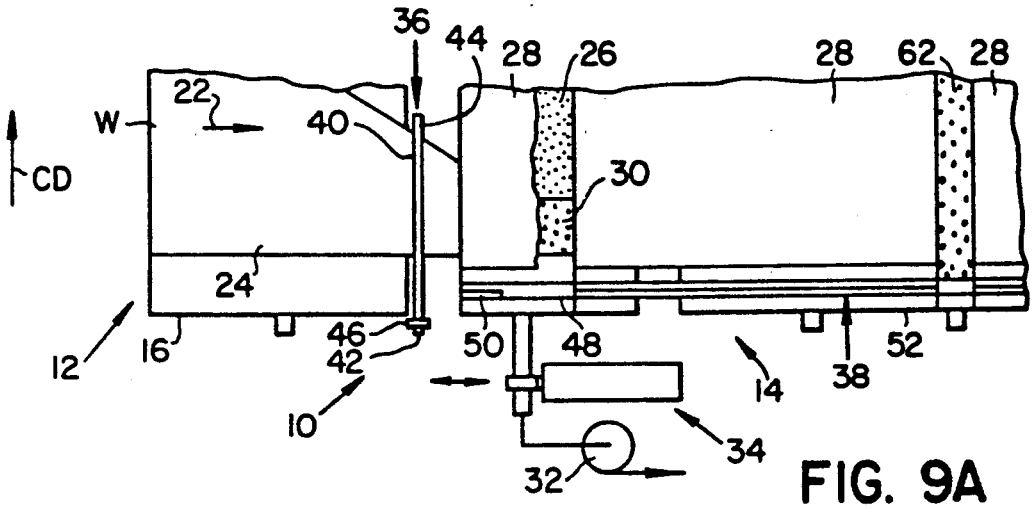
FIG. 9A
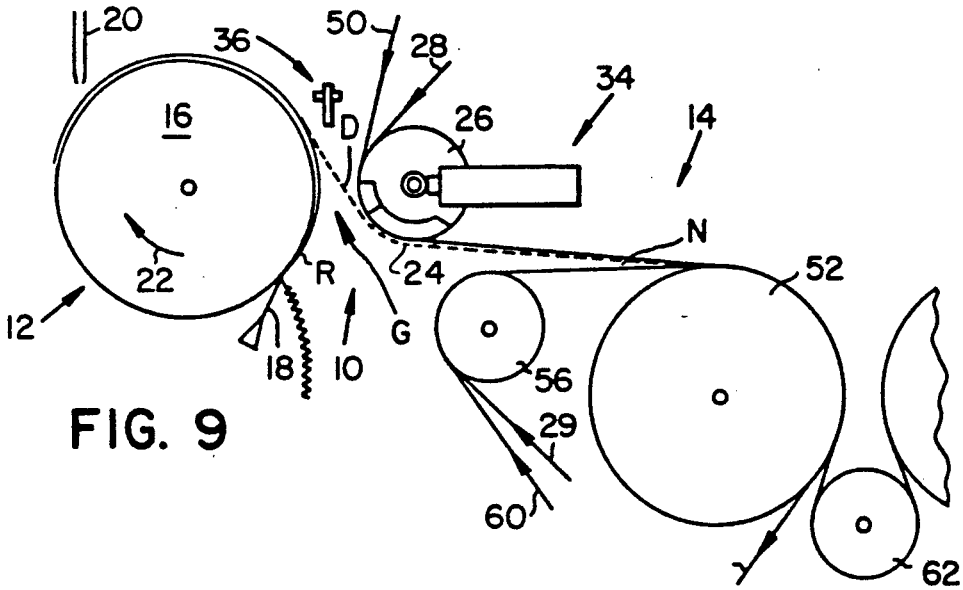
FIG. 9
FIG. 9B
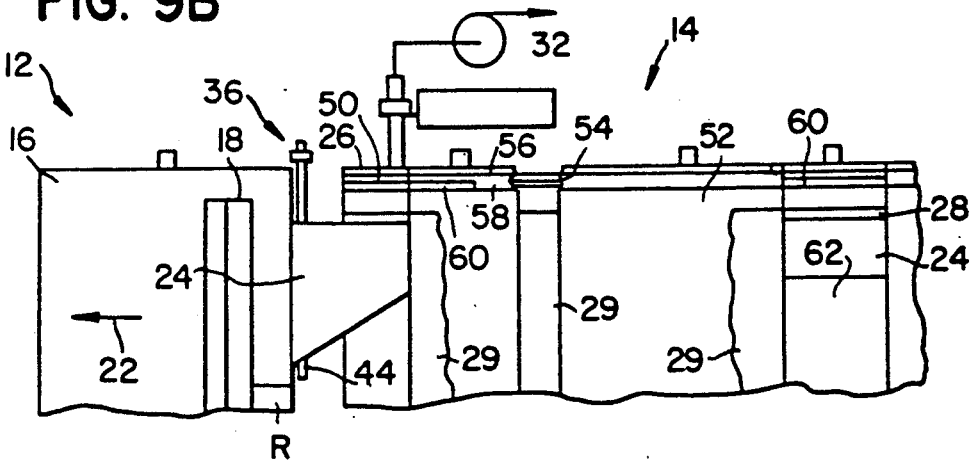

APPARATUS FOR TRANSFERRING A THREADING TAIL OF A WEB

BACKGROUND OF THE INVENTION

1. Field of the Invention

The present invention relates to an apparatus for transferring a threading tail of a web from a press section to a dryer section of a papermaking machine. More particularly, the present invention relates to an automatic apparatus for transferring a threading tail of a web such that the tail can be automatically threaded from a press section to a dryer section of a papermaking machine.

2. Information Disclosure Statement

In the papermaking art, excess water is usually pressed from a formed web by passing the formed web between counter-rotating press rolls or a series of counter-rotating press rolls.

Typically, one of the press rolls is a granite roll having a diameter of approximately five foot. Usually, such granite press rolls have a width in the region of 34 foot.

During the pressing operation, the granite press roll rotates at 3,000 to 4,000 feet per minute peripheral velocity, and in the event of a web breakage in the subsequent dryer section or in the starting-up operation, it is necessary to effect a transfer of the pressed web from the granite press roll to and around the downstream dryer section.

In order to carry out the aforementioned transfer, a doctor blade cooperates with the granite press roll such that the full width pressed web is doctored from the rotating granite press roll.

Subsequently, a narrow threading tail approximately 2 to 8 inches in width is cut by means of a water jet or the like disposed upstream relative to the press doctor. The arrangement is such that the threading tail and the remainder of the full width web are doctored from the press roll to a broke pit.

A lead-in roll of the dryer section guides a dryer felt into the vicinity of the press section. The dryer felt thereafter is guided from the lead-in roll to and around a baby dryer or the like of the dryer section.

A skilled operator equipped with an air wand or similar equipment then lifts the threading tail from the granite press roll and endeavors to blow the threading tail into the converging nip defined between a threading rope extending around the baby dryer cylinder such that the tail is threaded from the press roll into and around the dryer section.

Subsequently, when the tail has been threaded through the dryer section and the tail has been guided by the dryer felt out of engagement with the ropes, the threading tail is widened to a full width web such that the full width web is transferred from the press section into the dryer section.

In a more specific prior art transfer mechanism of the aforementioned type, a guide roll is disposed between the lead-in roll and the baby dryer. The lead-in roll includes an annular groove disposed at one end thereof for guiding a threading rope around the lead-in roll. The baby dryer is also provided with a corresponding further annular groove for guiding the threading rope from the lead-in roll to and around the baby dryer.

Similarly, the guide roll is provided with an annular rope groove, and a further rope extends around the annular rope groove of the guide roll and then subsequently around the further annular groove of the baby dryer.

In a threading operation, the operator in fact attempts to thread the tail between the converging nip defined between the two threading ropes. The arrangement is such that the tail is pinched between the converging ropes so that the threading tail is guided through and around each of the dryer cylinders of the drying section.

Those skilled in the art will appreciate the difficulties associated with the aforementioned threading arrangements. Although, a skilled operator may be successful in transferring a tail from a press section to a dryer section in a relatively efficient manner, it is not uncommon for operators to spend several hours during a single day attempting to transfer a web. In the meantime, the pressed web is doctored to broke, and a typical papermaking machine operating to broke costs in the region of $40,000 per hour in lost production.

More specifically, in a prior art threading operation, the operator blows the tail off of the last press roll and away from the doctor blade. By skillfully directing the air out of the blowing device, the tail can be directed towards and into the nip created between the following dryer felt and the first dryer cylinder.

The dryer section speed is then set at the value adequately higher than the press section speed so that the slack in the tail is pulled out and the tail is then tensioned.

Once the tail is stabilized, it is carefully and manually removed from the felt and slowly pulled outward until it enters the nip between two special threading ropes which carry the tail to the end of the dryer section. Once the tail reaches the end of the dryer section, the tail at the press area is manually released and allowed to stabilize again on the dryer felt.

After the tail is running in a stable fashion through the dryer section, the wet end tail cutting device is slowly moved toward the back side of the web so that the tail widens until a full width sheet is running through the dryer section.

The problems experienced with this type of manual operation are that the transfer requires considerable skill, and it cannot always be accomplished consistently and quickly.

Several methods have been proposed in the past to automate this transfer, but none of these methods have been very successful. One such method was suggested in a publication by Scapa-Porrit Ltd. entitled "Felts and Fabrics Sheet Flutter in the Dryer Part". The aforementioned method includes a suction roll which is placed within the first dryer felt run and nipped against the last press roll. The suction in the roll is intended to pull the full width web from the press roll and transfer it into the dryer section. Three problems, at least, exist with the aforementioned approach. The suction roll does not consistently transfer the full width web uniformly across the entire width. Secondly, the draw, which is generally needed to maintain adequate sheet tension, cannot be produced between the nipped rolls. Thirdly, the problem of threading the web through the rest of the dryer section is simply moved from the press section to the dryer section.

Another attempt to automate the transfer is disclosed in West German patent DE 35 24 006 to Valmet. In the aforementioned approach, air jets are used to blow the tail from the press roll onto a conveyor belt in order to thread the tail into the dryer felt nip. After this operation, the tail can be blown off of the felt and into the threading ropes by air nozzles as taught by Kerttula U.S. Pat. No. 4,543,160. The aforementioned patents teach various attempts at automating the operations which are generally accomplished manually. The problems with the aforementioned arrangements are that the devices do not adequately accommodate normal variations in the web release from the press roll. Also, such arrangements do not accommodate for changes in web moisture and changes in local air currents. Additionally, efficient threading of the tail into the rope nip requires the tail to be held flat, in a stable manner without any slack, and air jets are not capable of such threading. Therefore, the results of the aforementioned methods are inconsistent, resulting in inefficient transfers.

Consequently, the present invention seeks to provide an apparatus for transferring a tail of a web from a press section to a dryer section such that the threading tail is transferred automatically without the need for manual intervention.

Therefore, it is a primary objective of the present invention to provide an apparatus for transferring a threading tail of a web from a press section to a dryer section that overcomes the aforementioned problems associated with the prior art arrangements and which makes a considerable contribution to the web transfer art.

Another object of the present invention is the provision of an apparatus for transferring a threading tail of a web which includes a lead-in roll having a suction tail box connected to a source of partial vacuum so that the tail box cooperates with the threading tail.

Another object of the present invention is the provision of an apparatus for transferring a threading tail of a web which includes means for moving a lead-in roll from a first to a second location. The first location is in close proximity to a press roll or even touching the press roll such that when a tail box is connected to a source of partial vacuum, the tail is drawn away from the press roll onto a dryer felt. The second location is spaced from the press roll such that an open draw is established between the press roll and the lead-in roll.

Another object of the present invention is the provision of an apparatus for transferring a threading tail of a web which includes a tail guiding means which contacts the threading tail for urging the tail laterally relative to the lead-in roll.

Another object of the present invention is the provision of an apparatus for transferring a threading tail of a web which includes threading rope means which extend around a lead-in roll. The rope means are disposed such that the tail is moved laterally along the lead-in roll into a nipping relationship relative to the rope means.

Other objects and advantages of the present invention will be readily apparent to those skilled in the art by a consideration of the detailed description contained hereinafter taken in conjunction with the annexed drawings.

SUMMARY OF THE INVENTION

The present invention relates to an apparatus for transferring a threading tail of a web from a press section to a dryer section of a papermaking machine. The apparatus includes a press roll for releasably supporting the web. A doctor blade cooperates with the press roll such that when the blade is in an operative disposition in physical contact with the press roll, the web is doctored off of the press roll.

A tail cutting means is disposed upstream relative to the blade for cutting the web in a machine direction such that a threading tail is cut from the web. A lead-in roll is disposed adjacent to the press roll and between the tail cutting means and the doctor blade.

A dryer felt extends around and is guided by the lead-in roll. The dryer felt guides and supports the threading tail from the lead-in roll to the dryer section.

The lead-in roll also includes a suction tail box which is connected to a source of partial vacuum so that the tail box cooperates with the threading tail.

Means are provided for moving the lead-in roll from a first to a second location. The first location is in close proximity to the press roll such that when the tail box is connected to the source of partial vacuum, the threading tail is drawn away from the press roll onto the dryer felt. This action can be assisted by automated air wands. The second location of the lead-in roll is spaced from the press roll such that an open draw can be established between the press roll and the lead-in roll, when necessary.

A tail guiding means is movable from a first disposition to a second disposition thereof. The first disposition is such that the tail guiding means is retracted from contact with the threading tail. The second disposition of the tail guiding means is such that the guiding means physically contacts the tail for urging the tail laterally relative to the lead-in roll.

A threading rope means extends around the lead-in roll. The arrangement is such that when the tail guiding means moves to the second disposition thereof, the tail guiding means urges the tail laterally along the lead-in roll into a nipping relationship relative to the rope means so that the threading tail is transported by the rope means through the dryer section.

Subsequently, when the tail has been threaded through the dryer section and the tail has been guided by the dryer felt out of engagement with the ropes, the threading tail is widened to a full width web which is transferred from the press section to the dryer section.

In a more specific embodiment of the present invention, the tail cutting means moves in a cross-machine direction and then begins the initial cutting of the threading tail from the web. Thereafter, the tail cutting means moves further across the web in a cross-machine direction for widening the tail to a full width web.

The suction tail box is connected to the source of partial vacuum when the lead-in roll is disposed in the first location thereof such that when the tail is cut by the tail cutting means, the threading tail is drawn away from the press roll onto the dryer felt.

In a preferred embodiment of the present invention, the tail guiding means is an elongate rod having a first and a second end. The first end of the rod is pivotally secured for pivotal movement of the rod through a gap defined between the press roll and the lead-in roll when the lead-in roll is in the second location thereof. The arrangement is such that when the rod pivots about the first end thereof, the second end of the rod moves to the second disposition of the tail guiding means which is between the press roll and the lead-in roll. In such second disposition, the rod contacts the tail between the first and the second ends of the rod such that the rod urges the threading tail sideways into operative engagement with the threading rope means.

The threading rope means also includes an annular groove defined by the lead-in roll. A threading rope is guided by the annular groove such that the rope is guided around the lead-in roll.

A dryer cylinder of the drying section is disposed downstream relative to the lead-in roll with the cylinder defining a further annular groove for guiding the rope from the lead-in roll to and around the dryer cylinder.

A guide roll is disposed between the lead-in roll and the dryer cylinder with the guide roll defining a rope groove.

A further rope cooperates with the rope groove for guiding the further rope from the guide roll to and around the further annular groove of the dryer cylinder such that the rope and the further rope are disposed in abutting relationship within the further annular groove. The rope and the further rope define a converging nip upstream relative to the further annular groove. The converging nip cooperates with the threading tail for pinching the tail therebetween so that the tail is guided towards and around the dryer cylinder.

Many modifications and variations of the present invention will be readily apparent to those skilled in the art by a consideration of the detailed description contained hereinafter taken in conjunction with the annexed drawings. However, such modifications and variations fall within the spirit and scope of the present invention as defined by the appended claims.

Included in such modifications and variations would be the provision of a press-to-dryer transfer arrangement having no guide roll and being provided with a threading rope extending from a lead-in roll to and around a baby dryer and a cooperating further rope disposed in abutting relationship with the threading rope and extending around the baby dryer.

Also, the present invention includes an arrangement in which a transfer felt extends around the guide roll such that the web is transferred into the dryer section by a double felted transfer arrangement.

BRIEF DESCRIPTION OF THE DRAWINGS

FIG. 4 is a similar view to that shown in FIG. 1 but shows the lead-in roll moved to a second location to establish an open draw of the threading tail;

FIG. 4A is a top plan view of FIG. 4;

FIG. 4B is a bottom plan view of FIG. 4;

FIG. 5B is a bottom plan view of FIG. 5;

FIG. 6 is a similar view to that shown in FIG. 1 but shows the tail guiding means urging the threading tail laterally outwardly such that the threading tail is guided between threading ropes;

FIG. 6A is a top plan view of FIG. 6 showing the lateral movement of the threading tail;

FIG. 6B is a bottom plan view of FIG. 6 showing the threading tail engaged between the threading ropes and having been threaded around a baby dryer and transfer roll;

FIG. 7 is a similar view to that shown in FIG. 1 but shows the tail moved back out of engagement with the threading ropes;

FIG. 7A is a top plan view of FIG. 7;

FIG. 7B is a bottom plan view of FIG. 7 showing the threading tail extending through the dryer section;

FIG. 8 is a similar view to that shown in FIG. 1 but shows the tail guiding means retracted to a first disposition away from the threading tail;

FIG. 8A is a top plan view of FIG. 8 and shows the tail cutting means moving in a cross-machine direction for widening the tail;

FIG. 8B is a bottom plan view of FIG. 8;

FIG. 9 is a similar view to that shown in FIG. 1 but shows the tail being widened to a full width web;

FIG. 9A is a top plan view of FIG. 9 showing the threading tail being widened;

FIG. 9B is a bottom plan view of FIG. 9;

Similar reference characters refer to similar parts throughout the various views of the drawings.

DETAILED DESCRIPTION OF THE DRAWINGS

FIGS. 1, 1A, 1B to FIGS. 10, 10A, 10B show an apparatus generally designated 10 for transferring a tail of a web W from a press section generally designated 12 to a dryer section generally designated 14 of a papermaking machine.

Figure 1A:
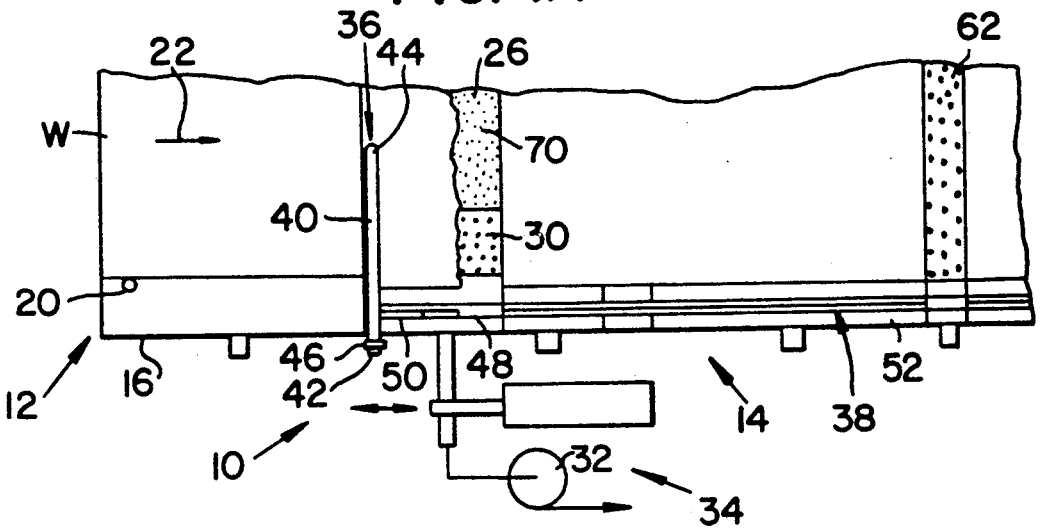
FIG. 1A is a top plan view of FIG. 1.
Figure 1:
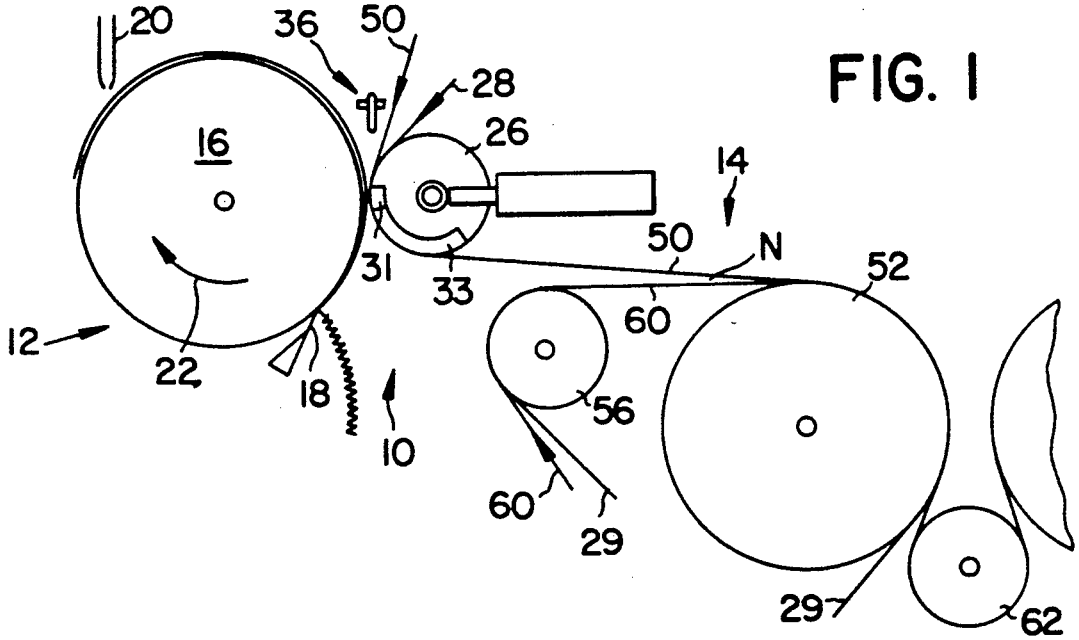
FIG. 1 is an elevational view of an apparatus for transferring a threading tail of a web from a press section to a dryer section according to the present invention.

The apparatus 10 includes, as shown in FIG. 1, a press roll 16 for releasably supporting the web W.

Figure 1B:
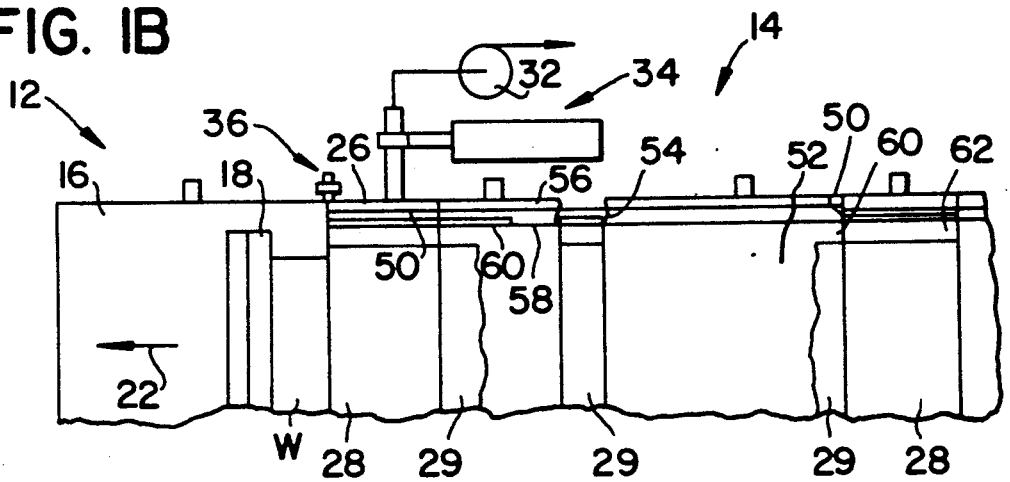
FIG. 1B is a bottom plan view of FIG. 1 showing the web being doctored to broke.

A doctor blade 18 cooperates with the press roll 16 such that when the blade 18 is in an operative disposition, as shown in FIGS. 1 and 1B in physical contact with the press roll 16, the web W is doctored off of the press roll 16.

Figure 2A:
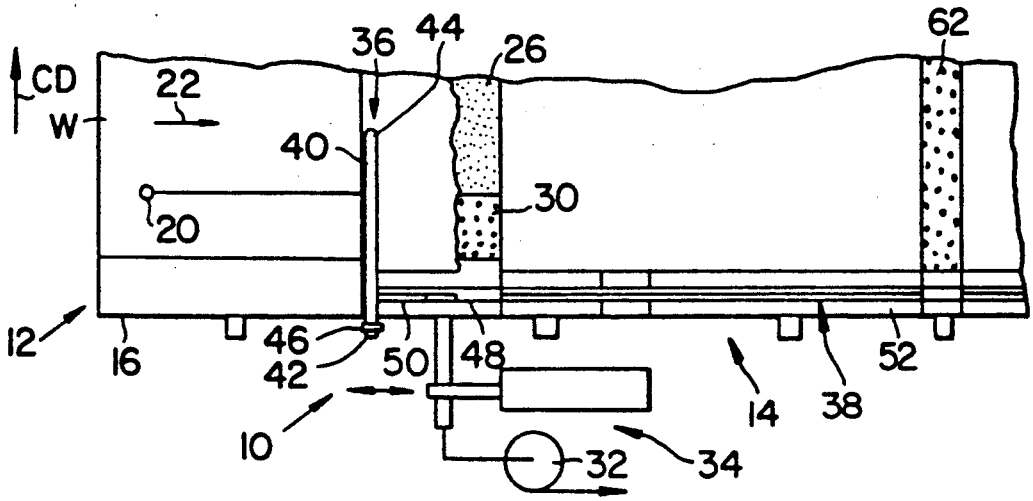
FIG. 2A is a top plan view of FIG. 2 showing the tail cutting means having moved in a cross-machine direction to cut a threading tail.
Figure 2:
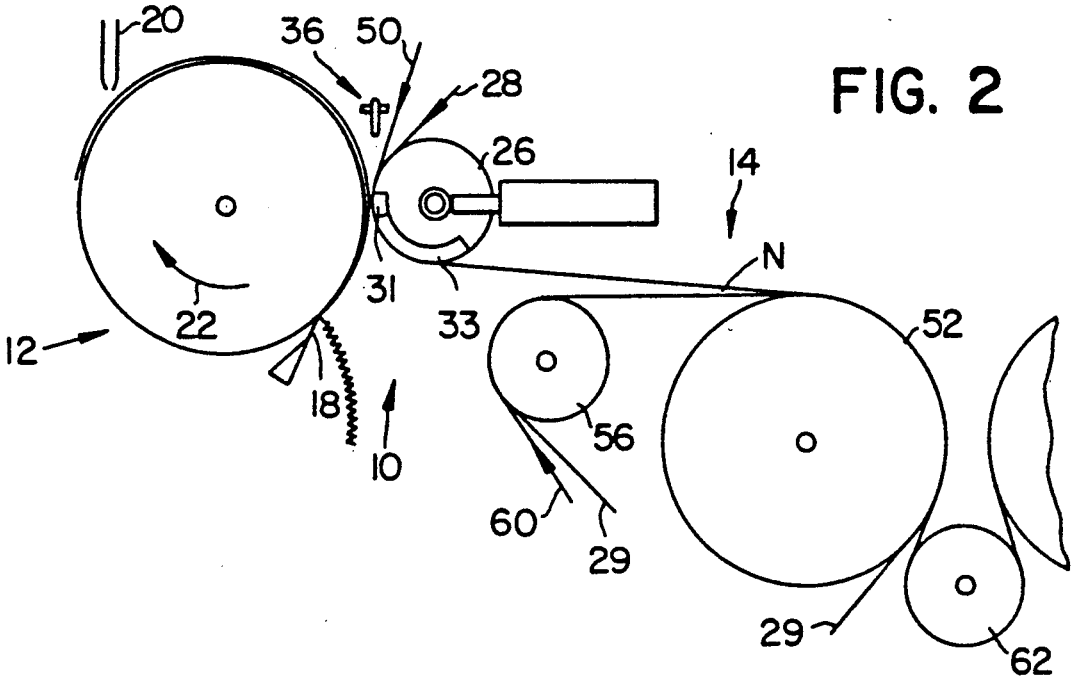
FIG. 2 is an elevational view similar to that shown in FIG. 1 but showing a tail cutting means having moved in a cross-machine direction.
Figure 2B:
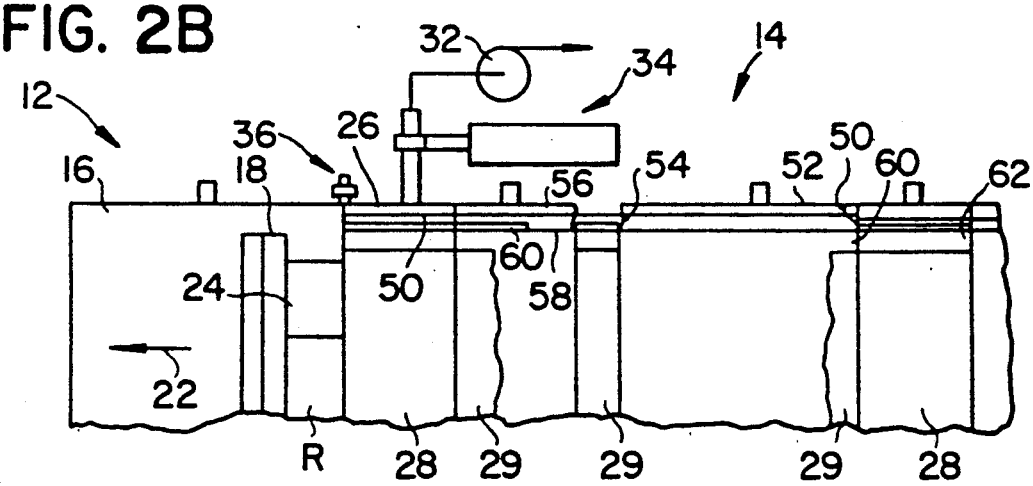
FIG. 2B is a bottom plan view of FIG. 2.

FIGS. 2, 2A and 2B show tail cutting means 20 disposed upstream relative to the blade 18 for cutting the web W in a machine direction, as indicated by the arrow 22, such that a threading tail 24 is cut from the web W.

The tail cutting means 20 is shown adjacent to the press roll 16 for clarity but would, in fact, be disposed adjacent to a fourdrinier wire in the forming section or at some other location upstream relative to the doctor blade 18.

A lead-in roll 26 is disposed adjacent to the press roll 16 and between the tail cutting means 20 and the doctor blade 18.

A dryer felt 28 extends around and is guided by the lead-in roll 26. The dryer felt 28 guides and supports the tail 24 from the lead-in roll 26 to the dryer section 14.

Figure 3A:
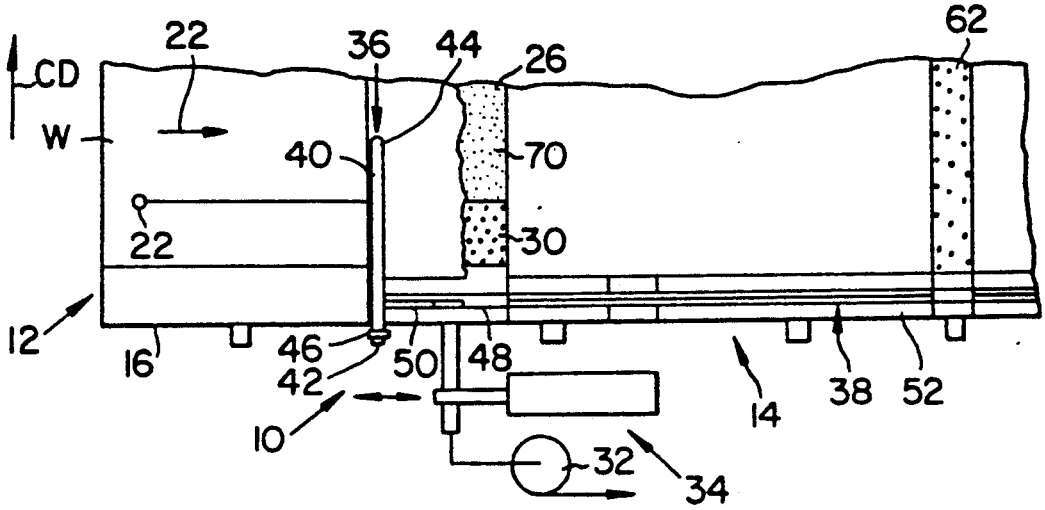
FIG. 3A is a top plan view of FIG. 3 showing more clearly the tail box.
Figure 3:
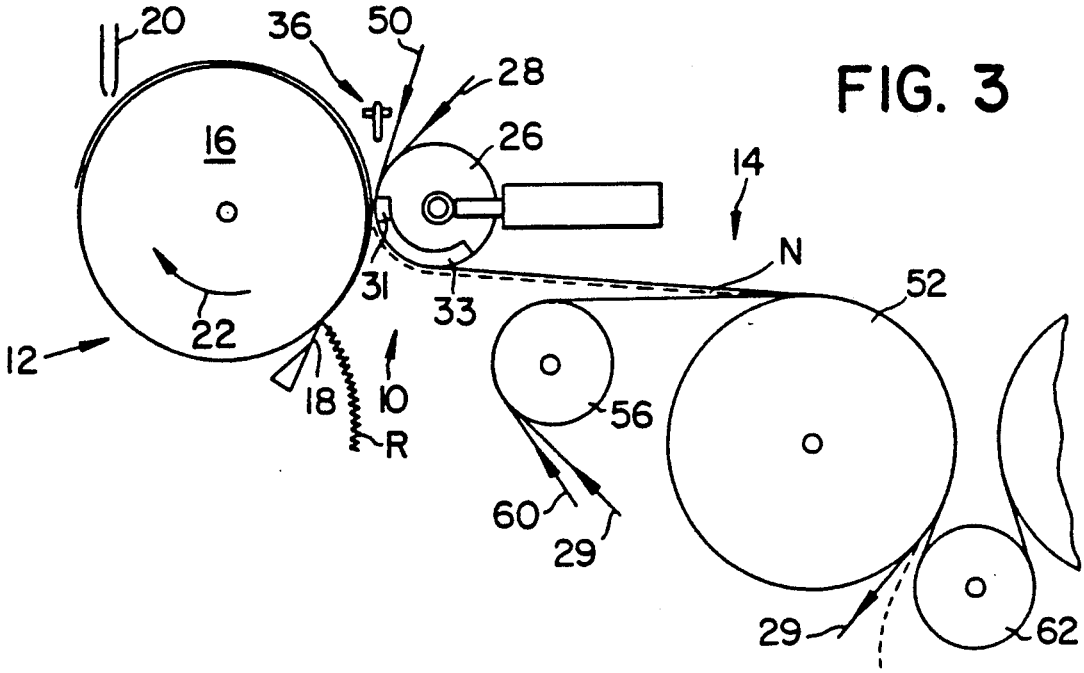
FIG. 3 is a similar view to that shown in FIG. 1 but shows the tail box connected to a source of partial vacuum and the threading tail drawn towards the dryer felt.
Figure 3B:
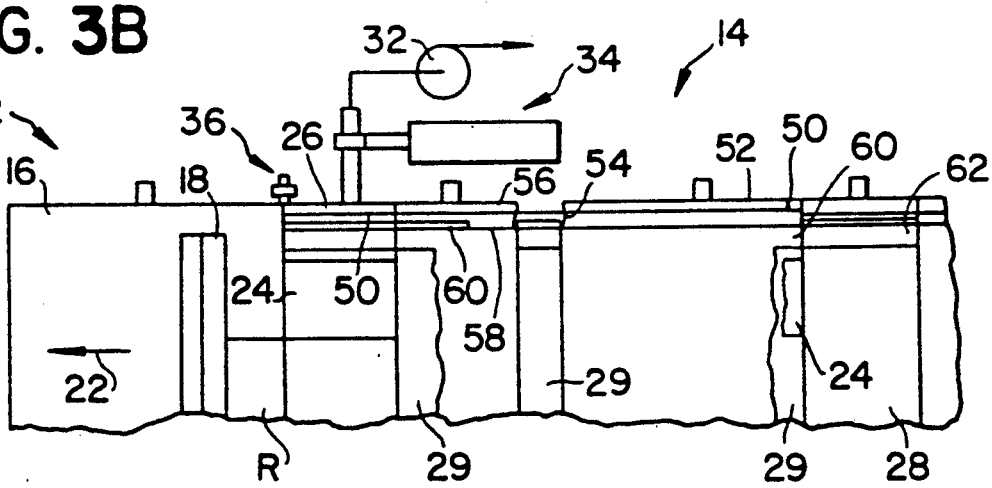
FIG. 3B is a bottom plan view of FIG. 3.

The lead-in roll 26, as shown in FIG. 2A, also includes a suction tail box 30 which is connected to a source of partial vacuum 32. The tail box 30 cooperates with the threading tail 24 as shown in FIGS. 3, 3A and 3B.

Means generally designated 34 is provided for moving the lead-in roll 26 from a first location, as shown in FIGS. 1, 1A, 1B to FIGS. 3, 3A, 3B, to a second location thereof, as shown in FIGS. 4, 4A, 4B to FIGS. 9, 9A, 9B.

The first location is in close proximity to the press roll 16 such that when the tail box 30 is connected to the source of partial vacuum 32, the tail 24 (shown in dashed lines) is drawn away from the press roll 16 onto the dryer felt 28, assisted, if necessary, by an automated air wand (not shown).

The second location of the lead-in roll 26 is spaced from the press roll 16 such that an open draw D is established between the press roll 16 and the lead-in roll 26.

Tail guiding means generally designated 36 is disposed between the press roll 16 and the lead-in roll 26 when the lead-in roll 26 is disposed in the second location. The guiding means 36 is movable from a first disposition, shown in FIGS. 1, 1A, 1B to FIGS. 4, 4A, 4B.

The tail guiding means 36 moves to a second disposition thereof, as shown in FIGS. 5, 5A, 5B to FIGS. 6, 6A, 6B.

The first disposition of the tail guiding means 36 is such that the tail guiding means 36 is retracted from contact with the tail 24.

The second disposition of the tail guiding means 36 is such that the tail guiding means 36 physically contacts the tail 24 for urging the tail 24 laterally relative to the lead-in roll 26 as shown in FIGS. 6, 6A and 6B.

Threading rope means generally designated 38 extend around the lead-in roll 26 such that when the tail guiding means 36 moves to the second disposition thereof, the tail guiding means 36 urges the tail 24 laterally along the lead-in roll 26 into a nipping relationship relative to the rope means 38, as shown in FIG. 6, so that the tail 24 is transported by the rope means 38 towards and through the dryer section 14.

FIG. 8 shows the tail 24 thereafter being widened to a full width web W which is transferred from the press section 12 to the dryer section 14.

As shown in FIGS. 2, 2A and 2B, the tail cutting means 20 moves in a cross-machine direction CD for initially cutting the threading tail 24 from the web W. Thereafter, the tail cutting means 20 moves further across the web W in a cross-machine direction CD, as shown in FIGS. 8, 8A and 8B, for widening the tail to a full width web. When the means 20 begins to cut the tail 24, the tail is a narrow wedge which is easily transported through the dryer section.

The suction tail box 30 is connected to the source of partial vacuum 32 when the lead-in roll 26 is disposed in the first location, as shown in FIGS. 1, 1A, 1B to FIGS. 3, 3A, 3B, such that when the tail 24 is cut by the tail cutting means 20, the tail 24 is drawn away from the press roll 16 onto the dryer felt 28. When the lead-in roll 26 has been moved to the second location away from the press roll 16, the tail box 30 may still be connected to the source of partial vacuum 32 for continuing to draw the tail 24 onto the dryer felt 28.

As shown in FIG. 1, the tail guiding means 36 is an elongate rod 40 having a first and a second end 42 and 44 respectively. The first end 42 of the rod 40 is pivotally secured for pivotal movement about a pin 46 or similar movement such that the tail is urged to translate outward relative to the lead-in felt roll and into nipped contact with the rope means 38. Such could include a pivoting mechanism including two rod pivoting arms of equal or unequal length to permit the aforementioned movement of the rod 40. The arrangement could also include a carriage arrangement on which the rod is pivotally mounted such that the rod can be moved into and out of engagement with the tail. The arrangement is such that the rod 40 is able to move through a gap G defined between the press roll 16 and the lead-in roll 26 when the lead-in roll 26 is in the second location, as shown in FIGS. 4, 4A, 4B to FIGS. 9, 9A, 9B.

The arrangement is such that when the rod 40 pivots about the first end 42 thereof, the second end 44 of the rod 40 moves to the second disposition between the press roll 16 and the lead-in roll 26, as shown in FIGS. 4, 4A and 4B. In the aforementioned disposition of the rod 40, the rod 40 contacts the tail 24 between the first and the second ends 42 and 44 of the rod 40 such that the rod 40 urges the tail 24 sideways, as shown in FIG. 6, into operative engagement with the threading rope means 38.

FIGS. 1A and 1B clearly show the threading rope means generally designated 38. The rope means 38 include an annular groove 48 defined by the lead-in roll 26, as shown in FIG. 1A.

A threading rope 50 is guided by the annular groove 48 such that the rope 50 is guided around the lead-in roll 26.

A dryer cylinder 52 of the drying section 14, such as a baby dryer, is disposed downstream relative to the lead-in roll 26. The cylinder 52 defines a further annular groove 54, shown in FIG. 1B, for guiding the rope 50 from the lead-in roll 26 to and around the dryer cylinder 52.

A guide roll or pulley 56 is disposed between the lead-in roll 26 and the dryer cylinder 52, the guide roll 56 defining a rope groove 58, as shown in FIG. 1B.

A further rope 60, as shown in FIGS. 1 and 1B, cooperates with the rope groove 58 for guiding the further rope 60 from the guide roll 56 to and around the further annular groove 54 such that the rope 50 and the further rope 60 are disposed in abutting relationship within the further annular groove 54, as shown more clearly in FIG. 1A.

As shown in FIG. 1, the rope 50 and the further rope 60 define therebetween a converging nip N which is disposed upstream relative to the further annular groove 54. The converging nip N cooperates with the tail 24 for pinching the tail 24 therebetween so that the tail 24 is guided towards and around the dryer cylinder 52.

Also, a transfer felt 29 runs around the guide roll 56 and cylinder 52. Additionally, the lead-in roll 26 includes a high vacuum level zone 31 and an intermediate vacuum level zone 33 disposed downstream relative to the zone 31. A low vacuum zone 70 is provided along the rest of the width of the roll 26.

In operation of the apparatus, the following sequence is carried out.

As shown in FIG. 1, the full width pressed web W extends around the press roll 16 and is doctored by the doctor blade 18 to a broke pit (not shown). The lead-in roll 26 is disposed adjacent to the press roll 16 in a first location thereof, and a tail cutting means 20 is disposed out of engagement with the full width web W.

Furthermore, the tail guiding means 36 is disposed in a first inoperative disposition thereof retracted from between the press roll 16 and the lead-in roll 26.

FIGS. 2, 2A and 2B show the tail cutting means 20 having been moved in a cross-machine direction CD such that a jet of water cuts a threading tail 24 from the full width web W.

The threading tail 24 and the remainder R of the full width web W, as shown in FIG. 2B, are doctored by doctor blade 18 to the broke pit, as clearly shown in FIG. 2B.

The tail box 30 and zones 31 and 33 are connected to the source of partial vacuum 32 such that the threading tail 24 is automatically drawn from the press roll 16 onto the moving dryer felt 28 such that the threading tail 24 supported by the dryer felt 28 moves towards the converging nip N while the remainder R of the full width web W is doctored to broke, as shown in FIG. 3.

FIGS. 4, 4A and 4B show the lead-in roll 26 having moved from a first to a second location. The second location is spaced from the press roll 16 such that an open draw D is established between the press roll 16 and the lead-in roll 26.

Figure 5A:
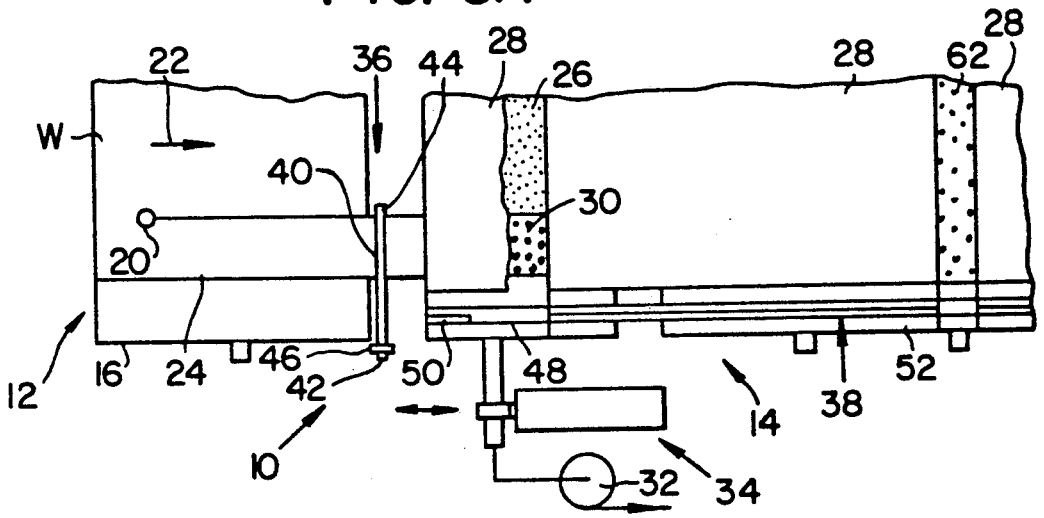
FIG. 5A is a top plan view of FIG. 5 showing the tail guiding means coming into contact with the threading tail.
Figure 5:
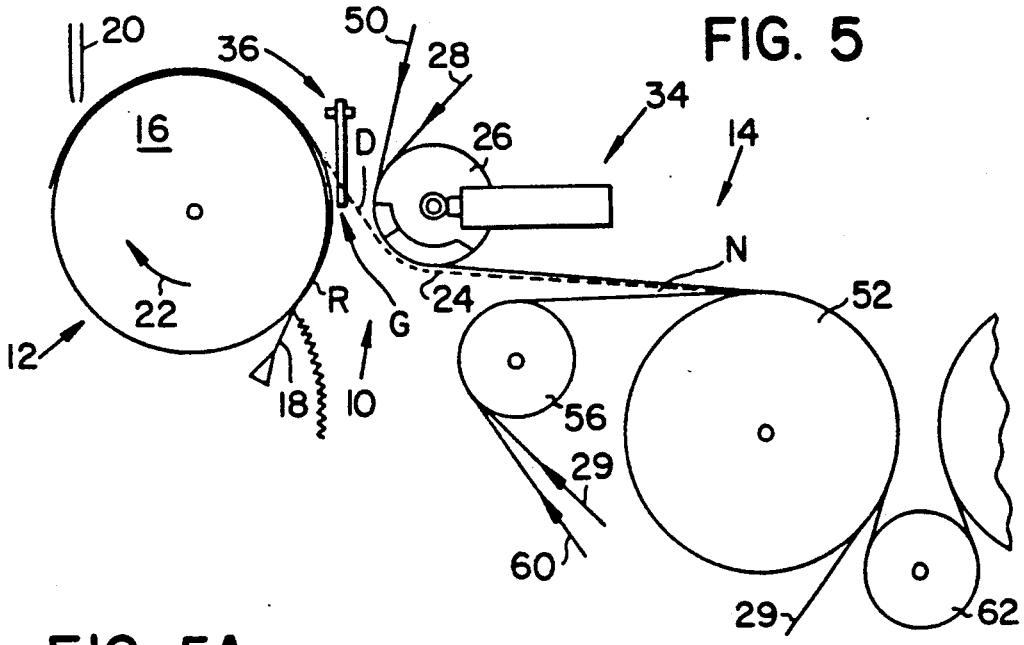
FIG. 5 is a similar view to that shown in FIG. 1 but shows a tail guiding means moving towards a second disposition thereof between the press roll and the lead-in roll.
Figure 5A:
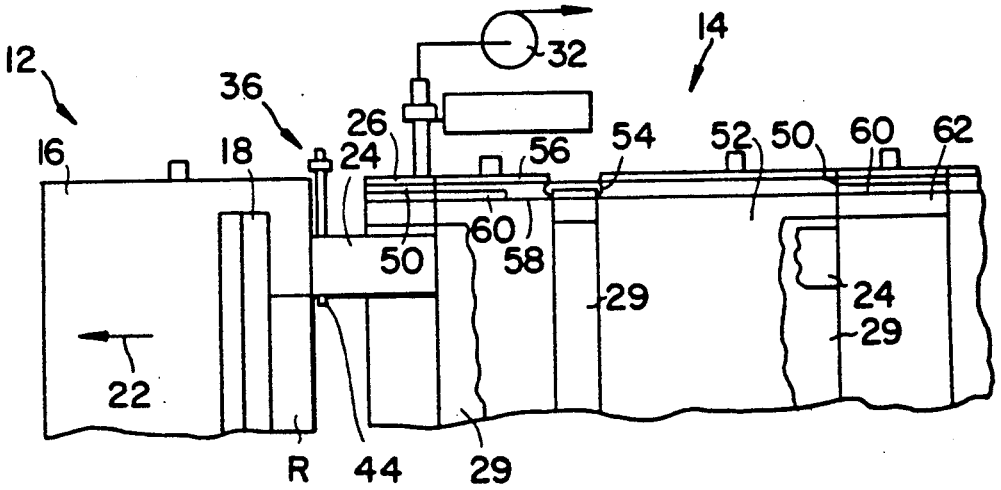

FIGS. 5, 5A and 5B show the tail guiding means 36 moving from a first disposition thereof to a second disposition between the press roll 16 and the lead-in roll 26 such that the guiding means 36 comes into physical contact with the tail 24 for urging the tail 24 laterally relative to the lead-in roll 26, as shown in FIG. 6.

FIGS. 6, 6A and 6B show the tail guiding means 36 further moving towards the second disposition thereof, and the threading tail 24 being urged by the rod 40 into a nipping relationship relative to the threading rope means 38. FIG. 6 also shows the tail 24 guided by the ropes being threaded around a transfer roll 62.

FIGS. 7, 7A and 7B show the threading tail 24 having been drawn between the respective threading ropes 50, 60 so that the threading tail 24 wraps around the baby dryer 52 and the dryer section. FIG. 7, however, shows the threaded tail 24 disengaged from the ropes 50 and 52 and threaded through the dryer section.

FIGS. 8, 8A and 8B show the tail cutting means 20 still supplying a high pressure water jet to cut the web W. However, the tail cutting means 20 moves further in a cross-machine direction CD for widening the threading tail 24, as clearly shown in FIG. 8A.

Additionally, FIGS. 8, 8A and 8B, as well as FIGS. 7, 7A and 7B, show the tail guiding means 36 once again retracted to the first disposition thereof, that is, a substantially horizontal disposition out of contact with the threading tail 24 moving in open draw D between the press roll 16 and the lead-in roll 26.

FIGS. 9, 9A and 9B show the tail 24 being widened to a full width web, and such widened tail being threaded across the open draw D from the press roll 16 to the dryer section 14.

Figure 10A:
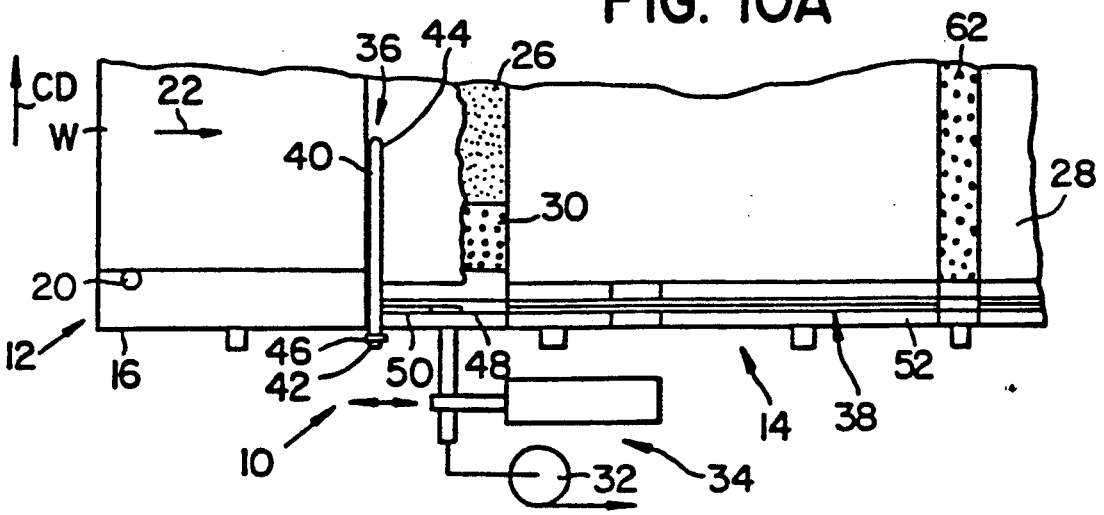
FIG. 10A is a top plan view of FIG. 10.
Figure 10:
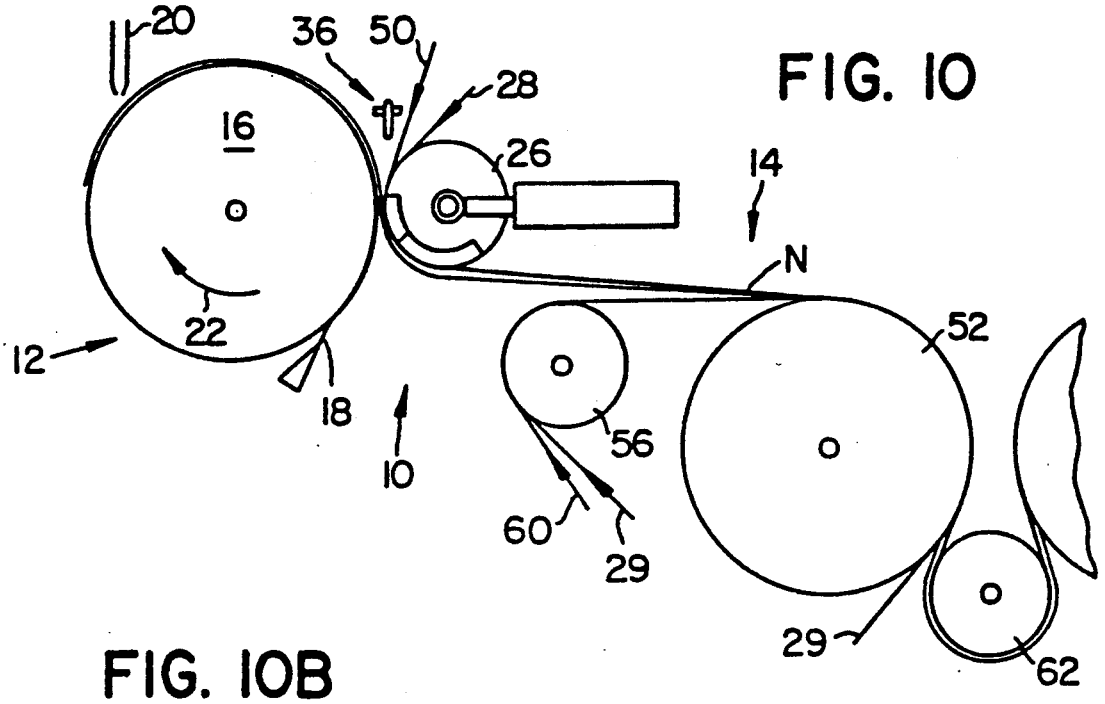
FIG. 10 is a similar view to that shown in FIG. 1 but shows the full width web being transferred from the press roll onto the dryer felt.
Figure 10B:
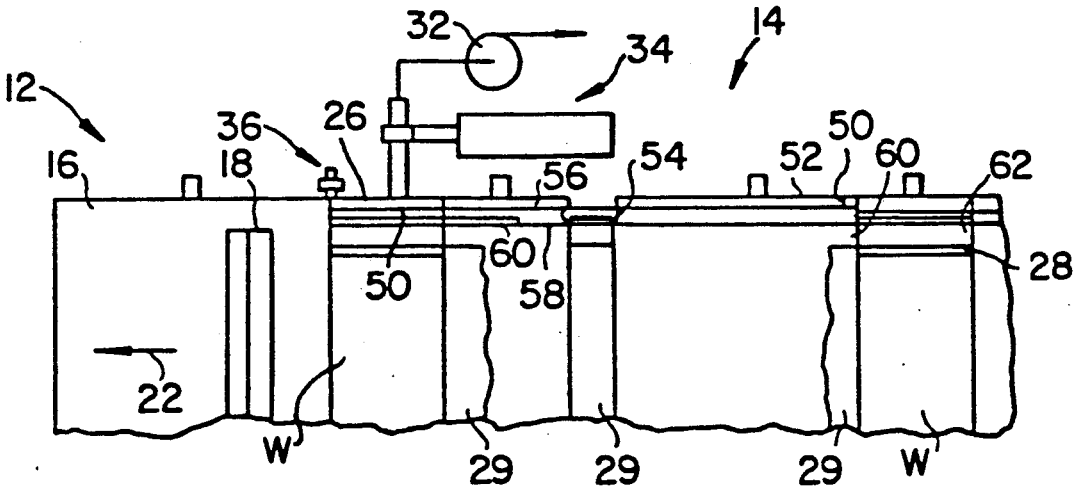
FIG. 10B is a bottom plan view of FIG. 10.

FIGS. 10, 10A and 10B show the full width web W being transferred from the press roll 16 to the lead-in roll 26 and with the full width web threaded through the dryer section.

Although one embodiment of the present invention has been described in detail, it is evident that many variations and modifications of the present concept can be carried out within the spirit and scope of the present invention. More specifically as described hereinbefore, the lead-in roll is constructed such that a high level vacuum is located adjacent to the press roll nip but the chamber, or tail box, does not extend across the full width of the web. Instead, a chamber substantially equal in width to the tail which is to be threaded is located substantially in line with the tail. With the aforementioned construction, only the tail is picked off the press roll, and this will avoid the need to handle the full width sheet in the dryer section. The aforementioned arrangement also avoids the need of providing a large vacuum system for a wide roll. Additionally, this arrangement avoids having to contend with non-uniformities in the suction transfer across the machine width.

However, the lead-in roll also includes an auxiliary vacuum chamber 70 which extends across the rest of the web width. Such vacuum chamber 70 is controlled at a lower vacuum level which is not capable of transferring the web from the press roll. The vacuum chamber 70 is used to reduce the air windage in this critical area by evacuating boundary layer air which is following the dryer and press felts. It is also used to provide a light support to the web as it is widened after the tail has reached the end of the dryer section.

Also, more specifically, the lead-in roll can be moved through a distance within the range 0 to 4 inches. The draw between the press and the dryer sections is simultaneously increased in order to maintain adequate web release and runnability. The tail is maintained in intimate contact with the dryer felt until the tail is disposed between the nip defined between the respective ropes.

Additionally, the special tailing rod is moved automatically in such a manner that the tail is slowly removed from the felt while remaining under tension due to the machine draw. More particularly, the rod does not extend in a direction substantially parallel to the press roll axis but rather at an oblique angle to the roll axis. Such angle then allows the rod to then be moved outward in a direction substantially parallel to the roll axis without the tail sliding off of the rod.

The aforementioned outward translation is so designed that the tail is moved into the nip between the threading ropes in a generally flat, stable, and controlled manner.

Once the web is full width, the draw can be reduced to normal operating levels, and the short open draw from the press roll can be reduced by pivoting the lead-in roll back towards the press roll.

Also, the arrangement may include three or more threading ropes.

The present invention provides an apparatus which automatically transfers a tail of the web from a press section to a dryer section of a papermaking machine, therefore avoiding the time-consuming and skilled operation of manually threading a tail from a press to a dryer section.

What is claimed is:

1. An apparatus for transferring a threading tail of a web from a press section to a dryer section of a papermaking machine, said apparatus comprising:

a press roll for releasably supporting the web;

a doctor blade cooperating with said press roll such that when said blade is in an operative disposition in physical contact with said press roll, the web is doctored off of said press roll;

tail cutting means disposed upstream relative to said blade for cutting the web such that the threading tail is cut from the web;

a lead-in roll disposed adjacent to said press roll and between said tail cutting means and said doctor blade;

a dryer felt extending around and guided by said lead-in roll, said dryer felt guiding and supporting the tail from said lead-in roll to the dryer section;

said lead-in roll further including: a suction tail box connected to a source of partial vacuum, said tail box cooperating with the threading tail;

means for moving said lead-in roll from a first to a second location, said first location being in close proximity to said press roll such that when said tail box is connected to said source of partial vacuum, the tail is drawn away from said press roll onto said dryer felt, said second location being spaced from said press roll such that an open draw is established between said press roll and said lead-in roll;

an elongate rod tail guiding means disposed between said press roll and said lead-in roll, said elongate rod guiding means being movable from a first disposition to a second disposition thereof, said first disposition being such that said elongate rod tail guiding means is retracted from contact with the tail, said second disposition being such that said elongate rod tail guiding means physically contacts the tail for urging the tail laterally relative to said lead-in roll; and threading rope means extending around said lead-in roll such that when said elongate rod tail guiding means moves to said second disposition thereof, said elongate rod tail guiding means urges the tail laterally along said lead-in roll into a nipping relationship relative to said rope means so that the tail is transported by said rope means towards the dryer section, the tail thereafter being widened to a full-width web which is transferred from the press section to the dryer section.

2. An apparatus for transferring a threading tail as set forth in claim 1 wherein said tail cutting means moves in a cross- machine direction for initially cutting the threading tail from the web, said cutting means thereafter moving further across the web in a cross-machine direction for widening the tail to a full width web.

3. An apparatus for transferring a threading tail as set forth in claim 1 wherein said suction tail box is connected to said source of partial vacuum when said lead-in roll is disposed in said first location such that when the tail is cut by said tail cutting means, the tail is drawn away from said press roll onto said dryer felt.

4. An apparatus for transferring a threading tail as set forth in claim 1 wherein said elongate rod tail guiding means has a first and a second end, said first end of said rod being pivotally secured for pivotal movement of said rod through a gap defined between said press roll and said lead-in roll when said lead-in roll is in said second location, the arrangement being such that when said rod pivots about said first end thereof, said second end of said rod moves to said second disposition between said press roll and said lead-in roll, said rod contacting the tail between said first and second ends of said rod such that said rod urges the tail sideways into operative engagement with said threading rope means.

5. An apparatus for transferring a threading tail as set forth in claim 1 wherein said threading rope means further includes:

an annular groove defined by said lead-in roll;

a threading rope guided by said annular groove such that said threading rope is guided around said lead-in roll;

a dryer cylinder of the drying section disposed downstream relative to said lead-in roll, said cylinder defining a further annular groove for guiding said threading rope from said lead-in roll to and around said dryer cylinder;

a guide roll disposed between said lead-in roll and said dryer cylinder, said guide roll defining a rope groove; and a further rope cooperating with said rope groove for guiding said further rope from said guide roll to and around said further annular groove such that said threading rope and said further rope are disposed in abutting relationship within said further annular groove, said threading rope and said further rope defining a converging nip upstream relative to said further annular groove, said converging nip cooperating with the threading tail for pinching the tail therebetween so that the tail is guided towards and around said dryer cylinder.

* * * * *

UNITED STATES PATENT AND TRADEMARK OFFICE

CERTIFICATE OF CORRECTION

PATENT NO. : 5,037,509

DATED : August 6, 1991

INVENTOR(S) : Gregory L. Wedel

It is certified that error appears in the above—identified patent and that said Letters Patent is hereby corrected as shown below:

Column 11, Line 23: Please insert --tail-- after "rod".

Signed and Sealed this

Fifteenth Day of December, 1992

*Attest:*

DOUGLAS B. COMER

*Attesting Officer*

*Acting Commissioner of Patents and Trademarks*